US006227014B1

(12) United States Patent
Euler et al.

(10) Patent No.: US 6,227,014 B1
(45) Date of Patent: May 8, 2001

(54) RECESSED VANE DUAL ACTION AGITATOR

(75) Inventors: John W. Euler, St. Joseph; Robert J. Pinkowski, Baroda; John Michael Hunnell, St. Joseph, all of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/338,465

(22) Filed: Jun. 22, 1999

(51) Int. Cl.[7] ..... D06F 17/10
(52) U.S. Cl. ..... 68/134
(58) Field of Search ..... 68/134

(56) References Cited

U.S. PATENT DOCUMENTS

| | | | | |
|---|---|---|---|---|
| D. 267,672 | | 1/1983 | Ohmann et al. | D32/26 |
| D. 314,263 | | 1/1991 | Mueller | D32/26 |
| D. 375,390 | | 11/1996 | Pinkowski | D32/26 |
| D. 381,140 | | 7/1997 | Pinkowski et al. | D32/26 |
| 2,149,987 | * | 3/1939 | Altorfer | 68/134 X |
| 2,312,541 | * | 3/1943 | Geldhof | 68/134 |
| 3,296,840 | * | 1/1967 | Tichenor | 68/134 |
| 3,381,504 | * | 5/1968 | Smith | 68/134 X |
| 4,555,919 | | 12/1985 | Brenner et al. | 68/134 |
| 5,577,888 | | 11/1996 | Capdevila et al. | 415/210.1 |
| 5,595,473 | | 1/1997 | Nagaoka et al. | 415/199.1 |
| 5,651,278 | | 7/1997 | Pinkowski | 68/134 |
| 5,730,582 | | 3/1998 | Heitmann | 416/188 |
| 5,730,583 | | 3/1998 | Alizadeh | 416/189 |

* cited by examiner

*Primary Examiner*—Philip R. Coe
(74) *Attorney, Agent, or Firm*—Andrea Powers Denklau; Thomas J. Roth; Robert O. Rice

(57) ABSTRACT

An agitator for a clothes washer having radially extending vanes and a slide member between the vanes. Vanes extend from the barrel portion of the agitator toward the outer perimeter of the skirt. The vanes have a base toward the barrel and a tip toward the outer perimeter of the skirt. The vanes have a right and a left side with each side having multiple planar faces for maximizing tip deflection. The pivot point, or connection point, of the base to the agitator has been lowered by connecting it to the center ring area of the skirt. Thus, vane breakage is reduced without decreasing washability. Slide members having a downward slope extend from the agitator barrel to the skirt at a slope less steep than the center ring area, but more steep than the slope of the skirt. These members move clothes from the barrel outward toward the perimeter of the skirt.

5 Claims, 4 Drawing Sheets

RECESSED VANE DUAL ACTION AGITATOR

BACKGROUND OF THE INVENTION

1. Field of the Invention

The present invention relates to an improved agitator structure, having flexible vanes and slide bars, that enhances clothes washability while minimizing fabric abrasion and vane breakage.

2. Description of the Related Art

The general construction of clothes washers is well known in the art. A common type of clothes washing machine is the vertical axis washer having an agitator and incorporating a submersion process. An imperforate tub is mounted in a perforated wash basket for receiving clothing and the tub is filled with a wash liquid of detergent and water. An oscillating or unidirectional agitator is positioned within the wash basket and imparts mechanical energy to the submerged clothing.

Many agitators have fins, or vanes, extending radially from the bottom portion of the agitator, just above the wash plate, similar to those described in U.S. Pat. No. 5,651,278 (Pinkowski) and U.S. Pat. No. 4,555,919 (Brenner et al.), assigned to the assignee of the present application, the disclosure of which is incorporated by reference herein. The vanes help push the clothes in a circular direction around the center agitator post, or barrel, and impart mechanical energy to the swirling wash liquid. As will be appreciated, there must be a balance between the strength and the flexibility of the vanes because it is desired to have vanes that do not break but also ones that reduce fabric abrasion.

Stress is exerted on vanes as they circulate water and push clothes in a circular direction. The vanes must flex in multiple directions to absorb the stress caused by circulating water and moving clothes without breaking off during the wash process. One method employed to provide flexibility is the use of a tapered vane where the vane has a thicker cross-section at the juncture with the center barrel portion of the agitator and a gradually thinner cross-section as it tapers toward the tip. It is also known to provide a vane that has not just one planar surface on each side, but multiple planar surfaces on each side. A popular agitator used today employs three planar surfaces on each side as the vane transitions from the center post to the tip. For the same stress, the use of three planes allows more deflection at the vane tip than the one plane, tapered vane. However, there is still stress exerted on the vane, especially in a twisting fashion, and it is desired to have the greatest deflection possible for a given amount of stress.

Additionally, it is necessary to have clothes turn over as the agitator rotates them so they do not get stuck next to the center barrel of the agitator. Therefore, many agitators in the prior art slope gradually from the center barrel to the skirt area to provide a means for rolling clothes outward. However, this construction requires a vane to be mounted above the slope so it is provided on the center barrel at a great vertical distance from the skirt, resulting in the mounted area of the vane absorbing a lot of the load. The loading in the bottom of the vane, below the connection point of the vane, is absorbed at the bottom connection point. Therefore, it would be an improvement to provide an agitator construction with a vane mounted closer to the skirt, thus lowering the bottom connection point of the vane, resulting in higher deflection for the same stress level.

The ability of a vane to absorb stress is also dependent upon the thickness of the vane. If other means of reducing stress, besides varying the thickness of the vane, can be achieved, then the thickness of the vane can be reduced. This increases flexibility of the vane. Often, to provide reliability against breakage, vanes are at least 2 mm thick.

For clothes washers having an agitator with vanes, it is desirable to have vanes that have superior tip deflection and slides between the vanes for rolling clothes outward, thus enhancing washability while minimizing vane breakage.

SUMMARY OF THE INVENTION

The present invention is directed to an agitator having vanes and slides. The agitator can be found vertically oriented in a wash tub of a clothes washing machine. The agitator has a skirt area with a substantially circular outer perimeter and a center ring area. The center ring has a substantially circular inner and outer perimeter and a center barrel extends upwardly from the center ring inner perimeter. At least two vanes are provided on the agitator of the present invention and they extend radially from the center barrel, thus dividing the skirt area into at least two substantially equal sections. The vanes have a right side and a left side and each side has at least two surfaces, or planes. A slide member is positioned within each of the sections for moving clothes from near the center barrel toward the skirt outer perimeter.

It is a further object of the invention to provide an agitator having no more than five vanes that are integrally molded to the barrel and with at least three planar surfaces on each side of the vanes.

It is an object of the invention to provide an agitator with a skirt center ring that slopes from the inner perimeter toward the outer perimeter at a first slope that is greater than a second slope from the center ring to the skirt outer perimeter.

It is a further object of the invention to provide an agitator having slide members with a first end integrally molded with the center barrel, a second end integrally molded with the skirt and a middle portion therebetween. The slide member slopes from the first end toward second end at a third slope that is less than the first slope of the center ring. The difference in the slopes causes the middle portion of the slide member to extend radially outward beyond the center ring.

It is an object of the invention to provide an agitator where the third slope of the slide member is greater than the second slope of the skirt area causing clothing to slide toward the outer perimeter of the skirt for a rollover action.

It is a further object of the invention to provide agitator vanes with a top edge, a bottom edge, a tip portion and a base portion, where the tip portion is thinner than the base portion. The base portion is mounted vertically to the barrel and along the slope of the center ring from the inner to the outer perimeter, and the bottom edge and the tip portion of the vane are positioned above the skirt area. Additionally, the base portion and the bottom edge meet to form a bottom point, or connection point, and the bottom point is positioned at a first vertical height. The tip portion and the bottom edge meet to form a tip point area and the tip point area is positioned at a second vertical height. The first height is not substantially greater than the second height causing a small difference between the vertical heights of the connection point and the tip area of the vane.

Another object of the invention is to provide an agitator with a section formed by two vanes and an arcuate length being defined by the length between the bottom points of the two vanes. The width of the middle portion of the slide is at least one-fifth the arcuate length.

Further, it is an object of the invention to provide an agitator where the bottom point of the vanes intersects the outer perimeter of the center ring and is attached to the skirt.

It is also an object of the invention to have the inner perimeter of the center ring positioned at a third vertical height, the outer perimeter of the center ring positioned at a fourth vertical height and the outer perimeter of the skirt positioned at a fifth vertical height such that the third height is greater than the fourth height and the fourth height is greater than the fifth height.

Further, it is an object of the invention to provide an agitator for an automatic washer for washing clothes where the agitator has a center barrel extending upwardly and surrounded by a skirt area having an outer circular perimeter. Vanes extend radially from the center barrel and divide the skirt area into at least three substantially equal sections. The vanes have a right side and a left side with at least two planar surfaces on each side. A slide member integrally molded to the barrel and skirt is positioned within each of the sections for moving clothes toward the skirt outer perimeter.

It is an object of the present invention to provide a slide having a generally smooth face for sliding clothes toward the outer perimeter of the skirt and an underside with a first portion attached to the barrel and a second portion attached to the skirt, including the center ring area.

Further, it is an object of the invention for the slope of the slide member to be steeper than the slope from the center ring to the skirt outer perimeter.

Additionally, it is an object of the invention to provide an agitator having vanes with a top edge, a bottom edge, a base portion and a tip portion. The base portion has an upper portion attached to the center barrel and a lower portion attached to the skirt.

DESCRIPTION OF THE PREFERRED EMBODIMENT

Figure 1:
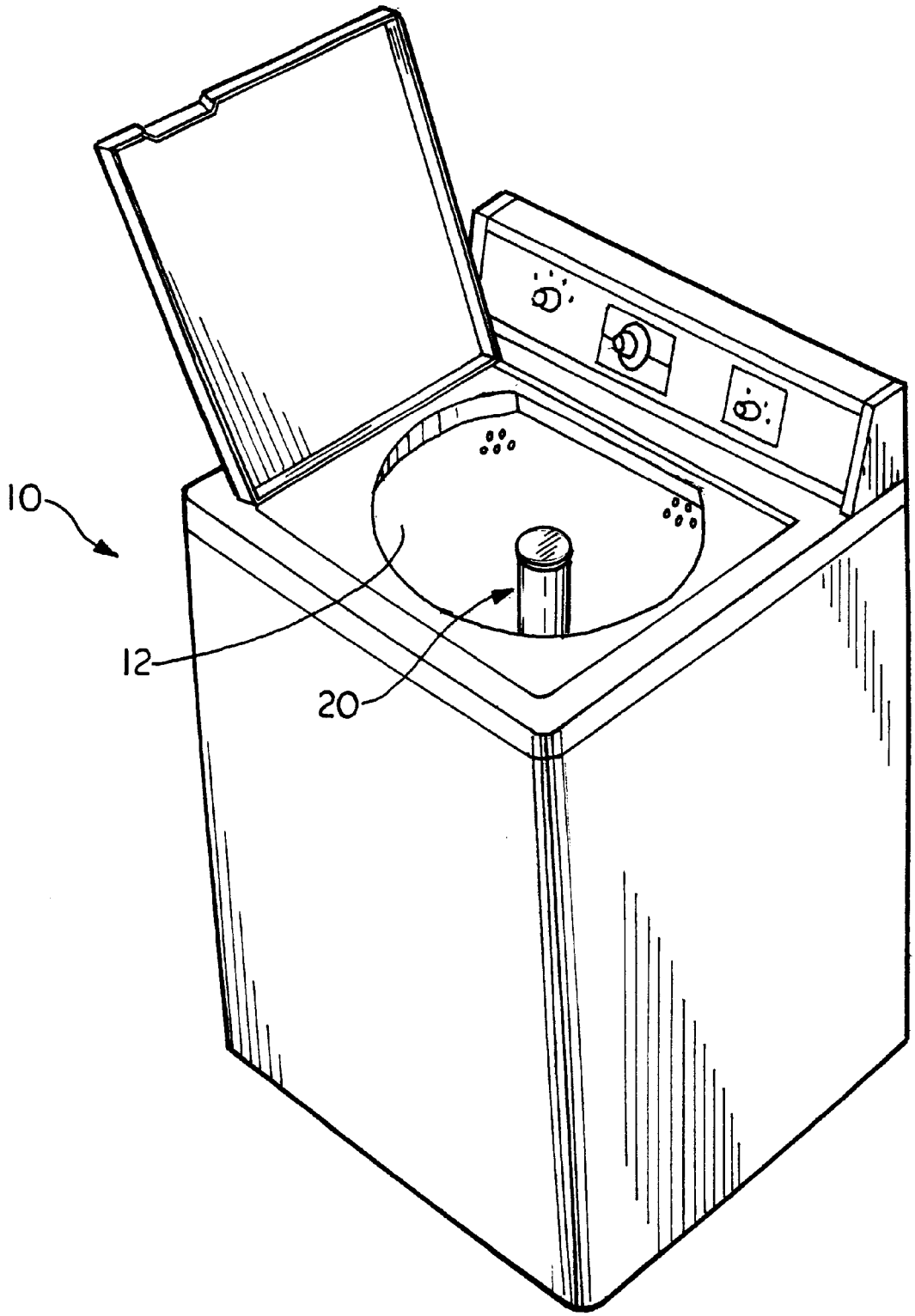
FIG. 1 is a perspective view of a clothes washer having an agitator according to the present invention.

In FIG. 1, a washing machine is generally shown at 10 providing the environment for the vertical agitator 20 positioned at the center of the tub 12. Agitator 20 preferably includes an auger driven by a unidirectional clutch, commonly known as a dual-action or three-way action agitator, but may also be a single-action agitator. The agitator is seen in greater detail in FIG. 2 where it is seen that the agitator is comprised of a vertical barrel portion 22 rising from a sloped skirt portion 24. Agitators 20 usually have a drive shaft (not shown) connected to the agitator barrel 22 to drivingly oscillate the agitator within the tub 12.

Figure 3:
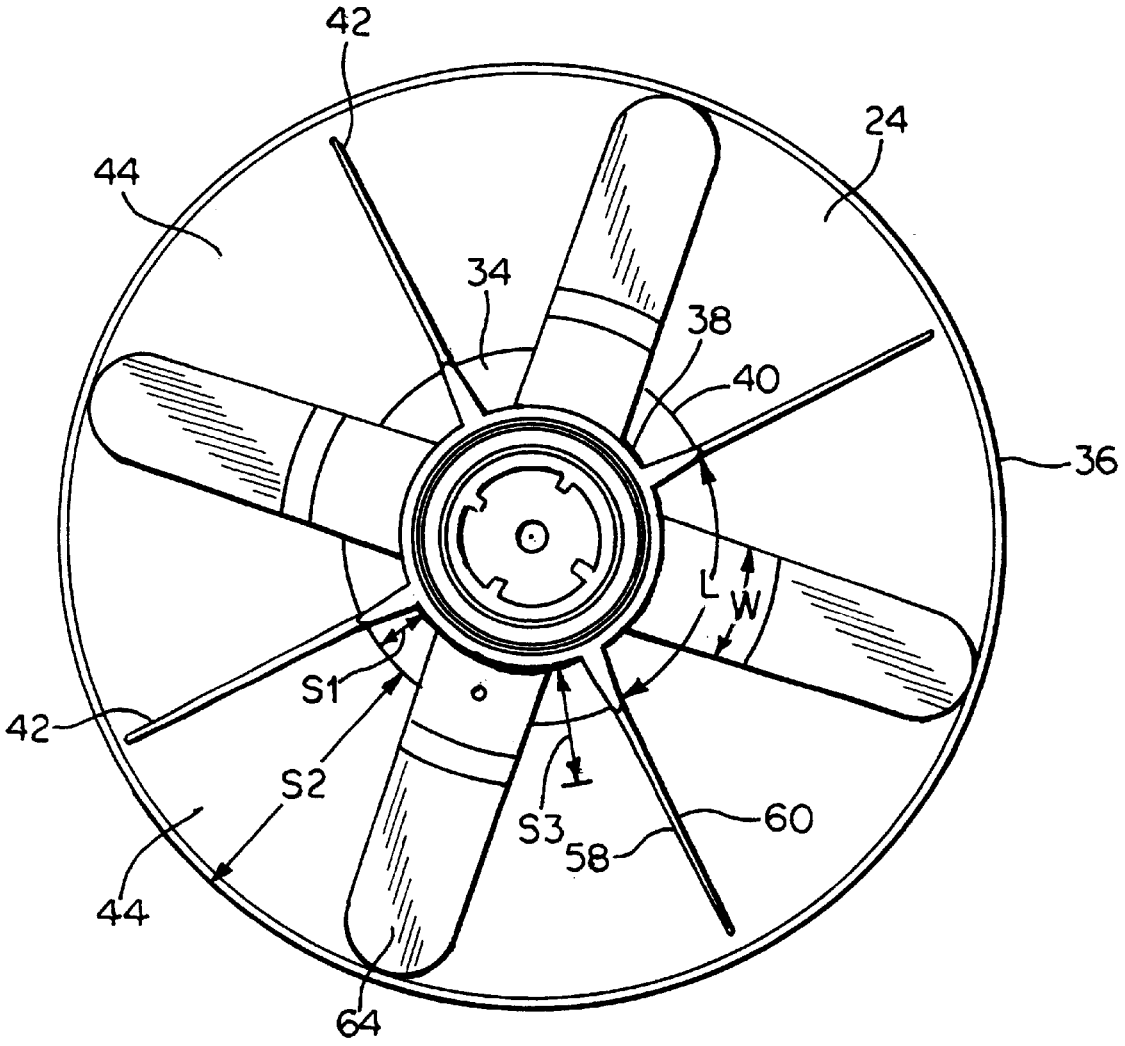
FIG. 3 is a top planar view of the agitator.

The agitator barrel 22 is substantially cylindrical and has a top end 26 and a bottom end 28, each end having a substantially circular perimeter 30 and 32, respectively. The skirt portion 24 is substantially circular and has a center ring area 34 and an outer perimeter 36. As seen in FIG. 3, the center ring 34 is substantially toroidal-shaped with an inner, generally circular perimeter 38 and an outer, generally circular perimeter 40. The center ring slopes from the inner perimeter 38 downward toward the outer perimeter 40. The inner perimeter 38 of the ring is a common perimeter with the perimeter 32 of the bottom end 28 of the barrel 22. The barrel extends substantially vertically upward from the inner perimeter 38 of the center ring 34 and the bottom of the barrel may be formed integrally with the inner perimeter 38 of the center ring to provide a smooth transition between the barrel 22 and the skirt 24.

The inner perimeter of the center ring 34 of the skirt 24 is positioned at height H1, the outer perimeter 40 of the center ring is positioned at height H2 and the perimeter of the skirt 36 is positioned at height H3. It can be seen in FIGS. 2 and 4 that the skirt 24 slopes downward from the inner perimeter 38 of the center ring to the skirt perimeter 36, thus height H1 is greater than height H2 and height H2 is greater than height H3. As seen in FIG. 3, the slope S1 between the inner perimeter 38 and the outer perimeter 40 of the center ring is greater than the slope S2 from the outer perimeter 40 of the center ring to the skirt perimeter 36. The slope S1 from the inner perimeter to the outer perimeter of the center ring is steep, preferably sloping from 90 degrees to 15 degrees with a transition of preferably no more than a 20 mm radius. The slope S2 from the center ring 34 to the skirt perimeter 36 is gradual, preferably no more than 20 degrees. Thus, the skirt 24 slopes more gradually than the center ring 34. It will be appreciated that there would be no center ring if the slope S1 were 90 degrees (vertical center ring) or the slope S1 were the same as the slope of the skirt S2 because the center ring would then be part of the barrel 22 or part of the skirt 24, respectively. The steep slope S1 of the center ring allows the bottom end 28 of the barrel to be positioned near the skirt area without having an abrupt, angular juncture.

Figure 4:
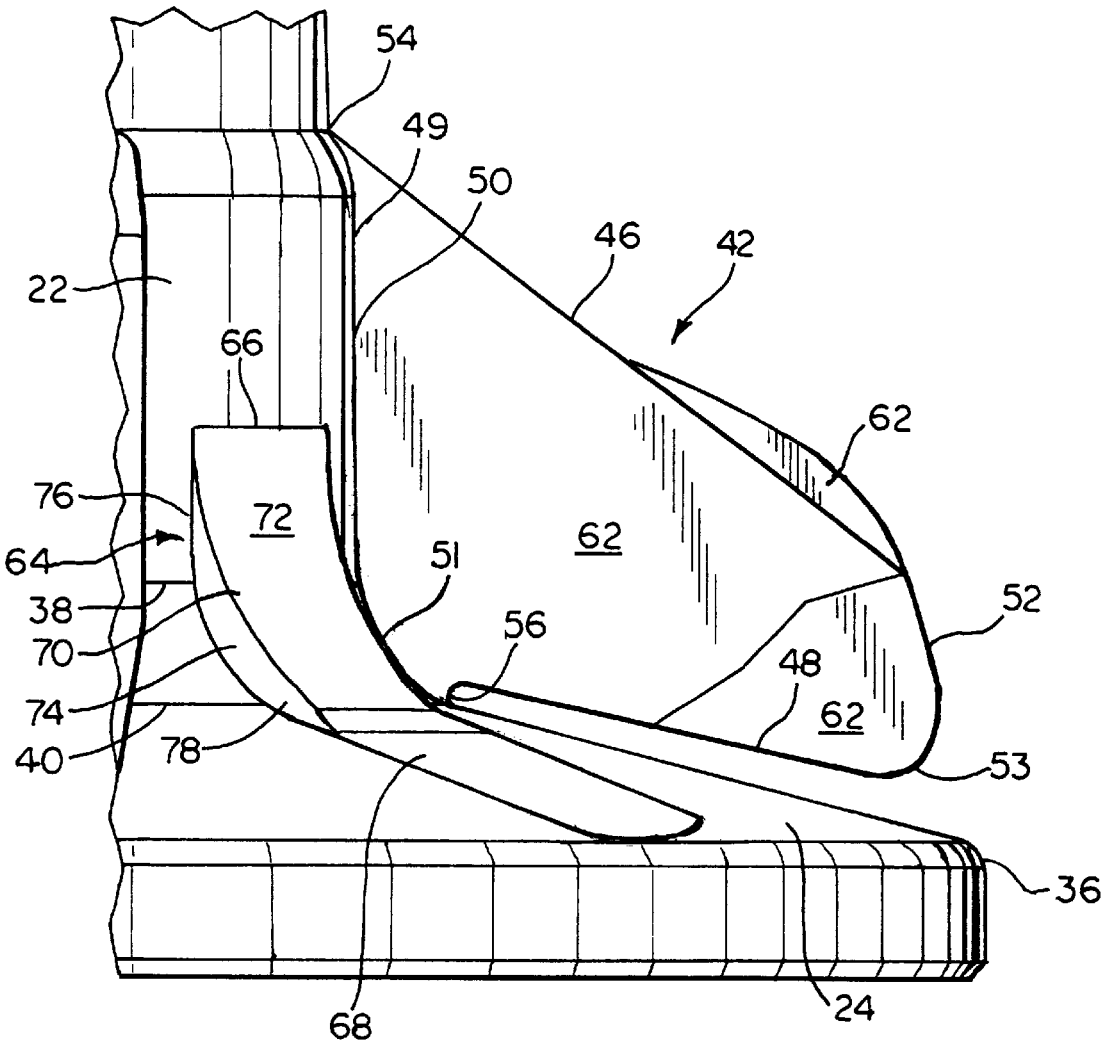
FIG. 4 is an enlarged view of the lower right portion of FIG. 2 showing elements of the agitator in greater detail.

Just above the skirt portion 24 of the agitator 20 are a plurality of angularly spaced, radially projecting flexible vanes 42. Four vanes are shown in FIG. 3 projecting radially from the barrel portion 22 of the agitator and dividing the skirt portion into substantially equal sections 44. As best seen in FIG. 4, each vane has a top edge 46, a bottom edge 48, a base end 50 and a tip portion 52. The base end 50 has a first portion 49 and a second portion 51. The vane is attached to the barrel 22 along the first portion 49 and is attached to the skirt's center ring 34 along the second portion 51 the entire height of the vane 42 which comprises the sole means of attachment of the vane to the agitator barrel 22. The bottom edge 48 of the vane is spaced above the skirt, thereby allowing the vane to flex about the base end 50.

The base has a top point 54 where the base end 50 and top edge 46 meet and a bottom point, or connection point, 56 where the base end 50 and bottom edge 48 meet. The top point 54 is attached to the barrel 22 and the bottom point is attached to the outer perimeter 40 of the center ring. Since the slope S1 of the center ring is steep, the base end 50 can be partially mounted to the skirt area along the second portion 51 for greater strength and flexibility. The tip portion 52 has a substantially rounded tip point 53 where the tip portion 52 and the bottom edge 48 meet. The connection point 56 is positioned at height H2 and the tip point 53 is positioned at height H4. It can bee seen in FIG. 2 that there is not a great difference between the height of the tip point H4 and the height of the connection point H2. By reducing the difference in these two heights, higher tip deflection for a given stress level is achieved because a smaller loaded area has to be absorbed at the point of connection 56.

Providing a vane capable of absorbing more stress allows the thickness of the vane to be reduced. The vanes 42 shown in FIG. 3 function well by flexing and not breaking with a to thickness between 0.75 mm and 1.5 mm.

Each vane has a left 58 and a right face 60 and each face is comprised of multiple planar surfaces 62. For example, the vanes shown in FIG. 2 have three planar surfaces on each face. The multiple planes 62 maximize flexibility so the vane is better able to bear the stress exerted by a load of clothes and wash liquid. It will be understood that any number of planar surfaces is possible and an infinite number of planes would provide the maximum tip deflection.

Figure 2:
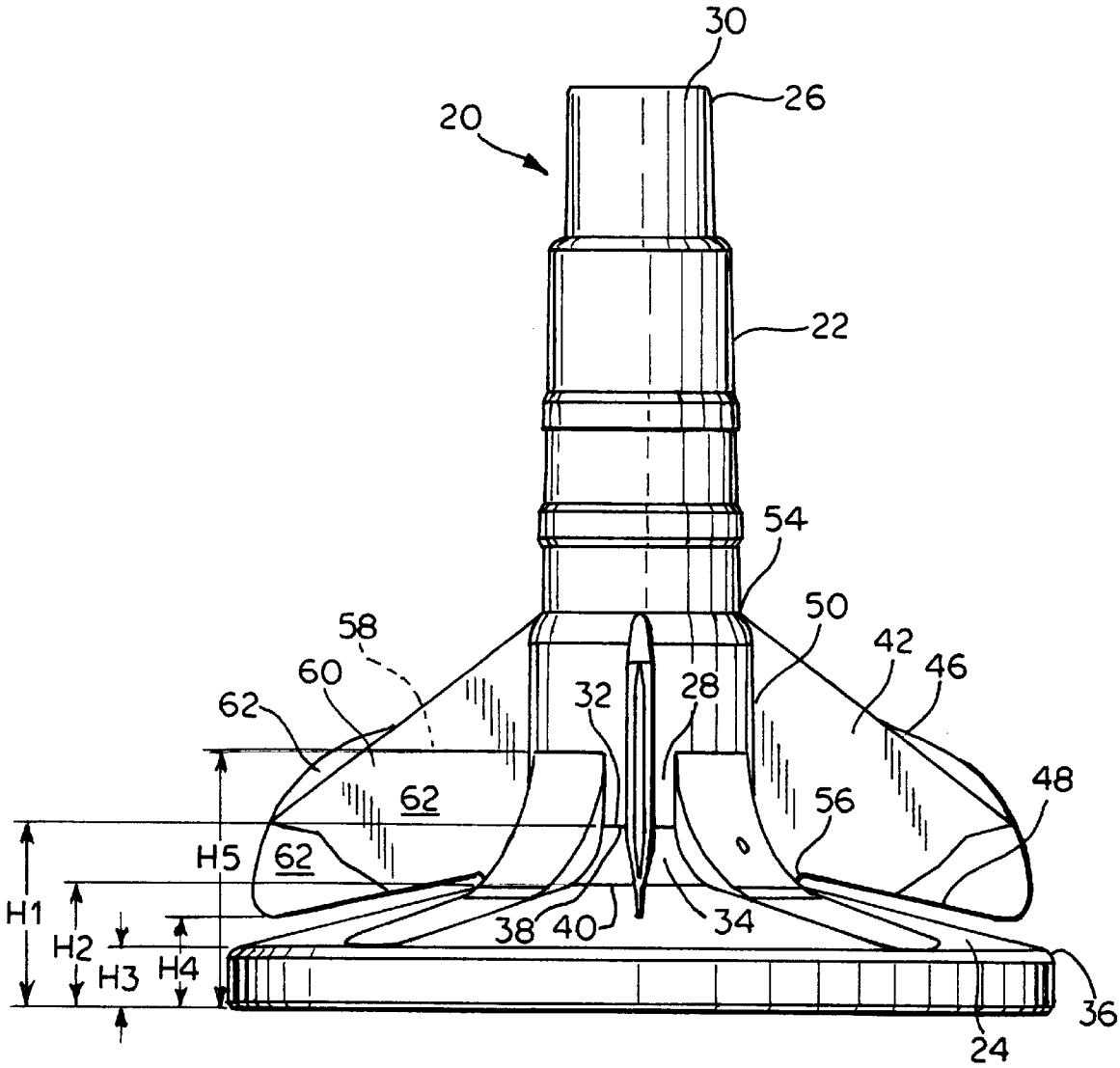
FIG. 2 is a side view of the agitator.

The radially projecting vanes form wedge shaped intervals 44 therebetween. As seen in FIGS. 3 and 4, a slide member 64 is positioned within each interval for facilitating clothes movement from near the agitator barrel 22 toward the outer perimeter of the skirt 36. The slide member 64 has a top end 66 positioned toward the agitator barrel 22, a bottom end 68 positioned toward the skirt area 24 and a middle portion 70 therebetween. Both the top 66 and bottom end 68 may be approximately equal in width. The slide member may have a generally smooth face 72 and an underside 74 having a first portion 76 attached to the barrel 22 and a second portion 78 attached to the skirt 24 and ring area. The overall appearance of the slide member 64 is similar to a ski slope or playground slide. The top end 66 may be integrally formed with the agitator barrel 22 and be positioned at a fifth height H5, as shown in FIG. 2. It can be seen in FIG. 3, that the top end 66 slopes downward toward the bottom end 68 at a slope S3 that is less than the slope S1 from the outer to the inner perimeter of the ring area. Therefore, the middle portion 70 of the slide member 64 extends outwardly from the center ring area and extends outwardly from a portion of the barrel 22 and the skirt area 24. The slide member 64 has a slope S3 with a larger radius than the slope S1 of the center ring to roll clothes toward the outer perimeter 36 of the skirt. Since the agitator barrel 22 and the skirt 24 meet at a steep slope S1, there is a "recessed" area around the agitator at the ring area 34. The slide member 64 functions to force the clothes away from this "recessed" area and washability is enhanced since clothes are rolled over and are not stuck next to the agitator barrel.

As shown in FIG. 3, two vanes form a section 44 and the distance between the connection point 56 of each vane 42 is an arcuate length L. It will be understood that this length L lies along the outer perimeter 40 of the center ring. The middle portion 70 of the slide member has a width W that is at least one-fifth the arcuate length L so the slide can properly move clothes toward the outer perimeter 36 of the skirt 24.

Generally, the ring area 34 of the skirt 24 allows the vane 42 to be recessed and the connection point 56 lowered on the agitator 20. This allows the connection point 56 to be placed at a vertical height closer to that of the tip point area 53, thus reducing the amount of load that bears on the connection point and providing greater tip deflection for the same amount of stress. The slide members 64 allow the vane 42 to be attached at a lower connection point without reducing washability because the clothes are still turned over since the slide members 64 move clothes toward the outer perimeter 36 of the skirt.

While the present invention has been described with reference to the above described embodiment, those of skill in the art will recognize that changes may be made thereto without departing from the scope of the invention as set forth in the appended claims.

We claim:

1. An agitator for an automatic washer for washing clothes, the agitator comprising:

a skirt having a bottom and a substantially circular outer perimeter and a center ring, said center ring having a substantially circular inner and outer perimeter, a center barrel having a generally cylindrical outer surface, said center barrel extending upwardly from the center ring inner perimeter, said center barrel defining a center axis, at least two vanes provided on and extending radially from the center barrel and dividing said skirt and said cylindrical outer surface of said center barrel into at least two substantially equal sections wherein said at least two substantially equal sections of said cyclindrical outer surface has an arcuate length, said vanes further having a top edge, a bottom edge positioned above said skirt, a tip portion and a base portion, said tip portion being thinner than said base portion, wherein the base portion and the bottom edge meet to form a connection point a first vertical distance from the bottom of the skirt and said connection point is positioned a first radial distance from said center axis, and a slide member positioned within each of the at least two sections for moving clothes from near the center barrel toward the skirt outer perimeter, said slide member having a top edge intersecting said center barrel, said top edge of said slide member having an arcuate length at least one-fourth said arcuate length of said equal sections of said cylindrical outer surface, wherein said slide has a surface at the first vertical distance and the surface of the slide at the first vertical distance is a second radial distance from said center axis and further wherein the first radial distance is less than the second radial distance.

2. The agitator as defined in claim 1, wherein:

each of said vanes includes a bottom tip point positioned at a second vertical distance from said bottom of said skirt, and said first vertical distance is not substantially greater than said second vertical distance.

3. An agitator for an automatic washer for washing clothes, the agitator comprising:

a skirt having a substantially circular outer perimeter and a bottom surface;

a center barrel having a generally cylindrical outer surface defining a center axis, said center barrel extending upwardly from the skirt, wherein the transition from the center barrel to the skirt is radiused and defines a center ring;

a plurality of vanes provided on and extending radially from the center barrel and dividing skirt and the cylindrical outer surface of the center barrel into at least two substantially equal sections wherein the at least two substantially equal sections of the cyclindrical outer surface has an arcuate length, the vanes further having a bottom edge positioned above the skirt and intersecting the center ring for defining connection point which is positioned a first vertical distance from the bottom of the skirt and is a first radial distance from the center axis; and a slide member positioned within each of the at least two sections for moving clothes from near the center barrel toward the skirt outer perimeter, the slide member having a relatively smooth, flat surface forming a radiused transition between the center barrel and the skirt and having a top edge intersecting with the center barrel, the top edge of the slide member having an arcuate length at least one-fourth the arcuate length of the equal sections of the cyclindrical outer surface, wherein the slide has a surface at the first vertical distance and the surface of the slide at the first vertical distance is a second radial distance from the center axis which is greater than the first radial distance.

4. The agitator as defined in claim 1, wherein:

the connection point is attached to the skirt.

5. An agitator for an automatic washer for washing clothes; the agitator comprising:

a skirt having a substantially circular outer perimeter and a bottom surface;

a center barrel having a generally cylindrical outer surface defining a center axis, said center barrel extending upwardly from the skirt, wherein the transition from the center barrel to the skirt is radiused and defines a center ring;

a plurality of vanes provided on and extending radially from the center barrel and dividing skirt and the cylindrical outer surface of the center barrel into at least two substantially equal sections wherein the at least two substantially equal sections of the cyclindrical outer surface has an arcuate length, the vanes further having a bottom edge positioned above the skirt and intersecting the center ring for defining connection point which is positioned a first vertical distance from the bottom of the skirt and is a first radial distance from the center axis; and a slide member positioned within each of the at least two sections for moving clothes from near the center barrel toward the skirt outer perimeter, the slide member having a relatively smooth, flat surface forming a radiused transition between the center barrel and the skirt and having a top edge intersecting with the center barrel, the top edge of the slide member having an arcuate length at least one-fourth the arcuate length of the equal sections of the cyclindrical outer surface, wherein the slide has a surface at the first vertical distance and the surface of the slide at the first vertical distance is a second radial distance from the center axis which is greater than the first radial distance.

* * * * *

UNITED STATES PATENT AND TRADEMARK OFFICE

CERTIFICATE OF CORRECTION

PATENT NO. : 6,227,014 B1
DATED : May 8, 2001
INVENTOR(S) : Euler et al.

It is certified that error appears in the above-identified patent and that said Letters Patent is hereby corrected as shown below:

Claim 3,
Line 38, should read:
-- 3. The agitator as defined in claim 1, wherein:
the connection point of the vanes intersects the outer perimeter of the center ring. --

Signed and Sealed this

Eighth Day of January, 2002

*Attest:*

*Attesting Officer*

JAMES E. ROGAN
*Director of the United States Patent and Trademark Office*